US009429016B2

(12) United States Patent
Derycke et al.

(10) Patent No.: US 9,429,016 B2
(45) Date of Patent: Aug. 30, 2016

(54) METHOD FOR REPLACING A TUNNEL BORING MACHINE ROLLER CUTTER, HANDLING DEVICE AND ROLLER CUTTER SUITED TO SUCH A METHOD

(75) Inventors: Jean-Noël Derycke, Versailles (FR); Sébastien Rubrecht, Paris (FR)

(73) Assignee: BOUYGUES TRAVAUX PUBLICS, Guyancourt (FR)

( * ) Notice: Subject to any disclaimer, the term of this patent is extended or adjusted under 35 U.S.C. 154(b) by 536 days.

(21) Appl. No.: 13/517,968

(22) PCT Filed: Dec. 14, 2010

(86) PCT No.: PCT/EP2010/069620

§ 371 (c)(1),
(2), (4) Date: Nov. 2, 2012

(87) PCT Pub. No.: WO2011/076616

PCT Pub. Date: Jun. 30, 2011

(65) Prior Publication Data

US 2013/0045055 A1 Feb. 21, 2013

(30) Foreign Application Priority Data

Dec. 22, 2009 (FR) ..... 09 59413

(51) Int. Cl.

| | |
|---|---|
| ***E21D 9/08*** | (2006.01) |
| ***E21D 9/10*** | (2006.01) |
| ***E21B 10/20*** | (2006.01) |

(52) U.S. Cl.

CPC ..... *E21D 9/08* (2013.01); *E21D 9/104* (2013.01); *E21B 10/20* (2013.01); *E21D 9/10* (2013.01); *Y10T 29/49817* (2015.01); *Y10T 29/53991* (2015.01)

(58) Field of Classification Search

CPC ..... E21D 9/08; E21D 9/10; E21B 10/20; E21B 10/12

USPC ..... 405/138; 299/55, 58; 175/373; 29/426.1, 283

See application file for complete search history.

(56) References Cited

U.S. PATENT DOCUMENTS

| | | | | |
|---|---|---|---|---|
| 3,779,323 | A * | 12/1973 | Horten et al. | 175/381 |
| 4,454,923 | A | 6/1984 | Tibussek | |
| 5,577,565 | A | 11/1996 | Kocab et al. | |

FOREIGN PATENT DOCUMENTS

| | | | |
|---|---|---|---|
| AU | 523 508 | B2 | 7/1982 |
| EP | 1 094 197 | A1 | 4/2001 |
| FR | 2 758 853 | | 7/1998 |
| JP | 58-189497 | | 11/1983 |
| JP | 2000213284 | a * | 8/2000 |

(Continued)

*Primary Examiner* — Sunil Singh

(74) *Attorney, Agent, or Firm* — Blakely Sokoloff Taylor & Zafman LLP

(57) ABSTRACT

The invention relates to a method for replacing a disk cutter (1) mounted with preload in a casing (2) attached to the cutting head of a tunnel boring machine, operated using a disk cutter (1) bearing, firmly attached thereto, an element (4) for locking into the housing (2) and preloading means (5), the method involving the steps of: a) removing a worn disk cutter (1) from said housing (2): • clamping a disk cutter (1) handling device (3) onto the housing (2); • taking hold of the disk cutter, • releasing the preload, • unlocking, • extracting the disk cutter (1), • unclamping the device (3), b) fitting a replacement disk cutter (1) in reverse order.

11 Claims, 8 Drawing Sheets

(56) References Cited

FOREIGN PATENT DOCUMENTS

| | | | |
|---|---|---|---|
| JP | 2002227590 | A | 8/2002 |
| JP | 2002227591 | A | 8/2002 |
| JP | 2003-307095 | A | 10/2003 |
| JP | 2004-211477 | A | 7/2004 |
| JP | 2006-009413 | A | 1/2006 |
| JP | 2007-070825 | A | 3/2007 |
| JP | 2007070825 | A | 3/2007 |

* cited by examiner

METHOD FOR REPLACING A TUNNEL BORING MACHINE ROLLER CUTTER, HANDLING DEVICE AND ROLLER CUTTER SUITED TO SUCH A METHOD

This is a non-provisional application claiming the benefit of International Application Number PCT/EP2010/069620 filed Dec. 14, 2010.

FIELD OF THE INVENTION

The present invention relates to a method for replacing a tunnel boring machine roller cutter on the cutting head of a tunnel boring machine, as well as a device for handling the roller cutter and a roller cutter suited to such a method.

BACKGROUND OF THE INVENTION

A roller cutter is a cutting tool that revolves freely around a shaft attached to the cutting head of a tunnel boring machine.

During rotation of the head and under the influence of thrust, the roller cutter rolls over the cutting face and chips out the rock in the form of scale-like plates.

Thus the cutting head includes a plurality of roller cutters evenly distributed over its surface.

Conventionally, the roller cutters are mounted within a housing on the cutting head by means of bolts.

The problem of changing the roller cutters occurs particularly in the case of a confined face tunnel boring machine, because access to the cutting head and to the roller cutter mounting hardware is difficult and the working environment is under hyperbaric conditions.

In such tunnel boring machines, the changing of the cutting head is carried out, for safety reasons, from the rear of the cutting head, that is the side of the cutting head opposite the cutting face.

The procedure for changing a roller cutter often demands the exertion of considerable force (sledgehammer blows for example) for loosening the used roller cutter from its housing, due to jams and the absence of guidance for the roller cutter, which is poorly compatible with work under hyperbaric conditions.

At present, the procedure for changing a roller cutter consists of equipping the roller cutter with lifting eyes, to lift it using a pulley block running along a rail, to load it onto a cart running through the equipment airlock and to bring it back to the rear inside the shield, at atmospheric pressure.

During dismantling, it is also necessary to progressively collect all the elements (wedges, screws, bolts, etc.) necessary for mounting the roller cutter and which will be re-used for mounting the new roller cutter.

Before inserting the new roller cutter into its housing, it must be properly positioned, which requires a painstaking manual intervention.

Once the roller cutter is pushed toward its operating position, several blocking wedges are put in place, which are held by means of bolts.

It will be understood that this procedure is long and tedious for the operators.

One object of the present invention is therefore to implement a method for replacing a roller cutter which makes it possible to reduce, or even to eliminate, any human intervention during the replacement of a roller cutter.

Another object of the invention is to propose a roller cutter which lends itself to such a method.

Another object of the invention is to obtain a roller cutter handling device suited to the implementation of this method, by making it possible in particular to avoid any loss of components.

Likewise, the roller cutter handling device must be easy to clean and not include any areas that retain water or mud.

Finally, this device must be usable in existing cutting heads without requiring modifications to the same.

BRIEF DESCRIPTION OF THE INVENTION

According to the invention, a method for replacing a roller cutter mounted with preloading inside a housing incorporated into the cutting head of a tunnel boring machine is proposed, implemented with a roller cutter permanently bearing a member for locking it into the housing and means for applying said preloading.

Said method comprises the steps consisting of:

a) removal of a used roller cutter from said housing, comprising the following steps:

clamping onto the housing of a handling device designed for grasping and guiding the roller cutter, grasping of the roller cutter by the handling device, releasing the preloading applied to the roller cutter, unlocking the roller cutter from the housing, extracting the roller cutter from the housing, unclamping the handling device from the housing, b) installation in said housing of a replacement roller cutter, comprising the following steps:

grasping of the roller cutter by the handling device, docking, then clamping the roller cutter handling device onto the housing, insertion of the roller cutter into the housing, said roller cutter being guided by the handling device, locking of the roller cutter into the housing, application of a preloading to the roller cutter.

With particular advantage, said method is implemented in an automated fashion using a mechanized system equipping the roller cutter handling device.

For implementing this method, the roller cutter permanently bears the elements that allow it to be locked and put under preload in the housing.

This avoids any loss of components during handling, dismantling and remounting of the roller cutter.

According to a preferred embodiment of the method, the roller cutter is held by the handling device through its locking member.

A second object of the invention is therefore a roller cutter designed for implementing said replacement method.

The locking member of said roller cutter is designed to be immobilized, so that the roller cutter constitutes a rigid block for the purpose of its handling.

According to a particular embodiment of the invention, the locking member includes a bayonet that is movable in rotation between a position for insertion of the roller cutter into the housing and a position for locking the roller cutter within the housing.

The means for preloading the roller cutter can include screws which are permanently born by the roller cutter.

Thus, said preloading screws are preferably carried by the bayonet in a way that precludes loss.

A third object of the invention is a device for handling the roller cutter in implementing said method for replacing a roller cutter.

More precisely, this handling device comprises:

an element for clamping onto the housing, an element for grasping the roller cutter, means for releasing or applying preloading to the roller cutter, an element for extracting the roller cutter a member for actuating the locking member of the roller cutter.

Advantageously, said device also includes means for cleaning the housing.

Further, said device preferably includes means of transporting, docking and/or clamping onto the housing by means of a robot.

A fourth object of the invention is a tunnel boring machine including a cutting head and a plurality of roller cutters such as those described above and housings built into the cutting head, said housings bearing contact surfaces for locking the roller cutters.

Said housing advantageously have contact surfaces for docking and guiding a roller cutter handling device such as that described above.

Finally, the roller cutters and the housings advantageously have respective complementary supporting contact surfaces for centering and guiding the roller cutter within the housing.

BRIEF DESCRIPTION OF DRAWINGS

Other features and advantages of the invention will appear from the detailed description that will follow, with reference to the appended drawings in which.

DETAILED DESCRIPTION OF THE INVENTION

Figure 1A:
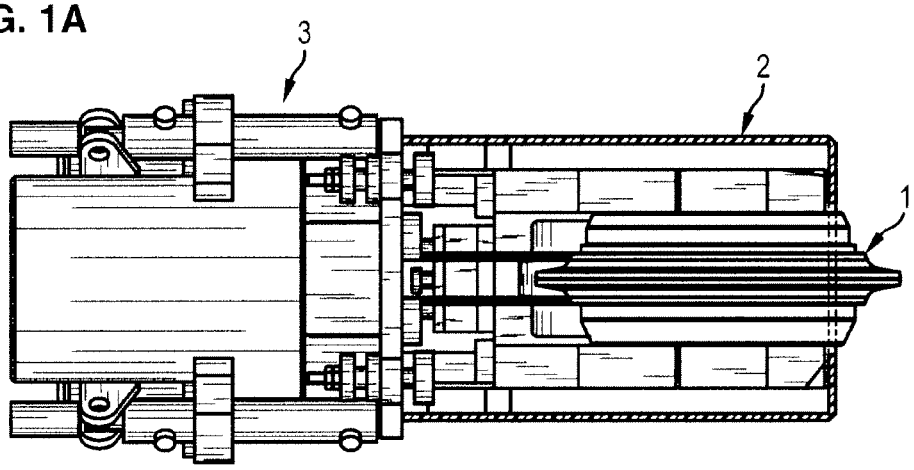
FIG. 1A shows a roller cutter inside a housing and a device for guiding the roller cutter in a roller cutter change situation.

When the tunnel boring machine is put into service, each roller cutter is installed in its housing while being subjected to a preloading which allows it to resist the forces to which it will be subjected during cutting.

Conventionally, the housing for its part is affixed to the cutting head, typically by welding.

As will be seen below, the procedure for installation and extraction of the roller cutter is facilitated by the fact that the locking and preloading elements are permanently born by the roller cutter.

What is meant by "permanently born" is that the different elements allowing locking and preloading of the roller cutter within the housing can have relative motion with respect to one another, but that they remain mechanically connected to one another without the possibility of naturally separating.

Method for Replacing a Roller Cutter

The extraction of a used roller cutter from its housing is implemented during the following steps.

Removal of a Used Roller Cutter

First of all, a roller cutter handling device, the structure whereof will be discussed below my means of an example, is brought to the housing via the back face (that is, as stated above, the face opposite the cutting face) of the cutting head.

The delivery of the handling device can be carried out in a semi-automated manner by means of a pulley block, or in a completely automated manner, through the use of a handling robot.

The handling device and the housing have respective contact surfaces which cooperate to allow guidance and docking of the handling device on the housing.

Once in position, clamping elements, of the handling device for example, or of the carrying robot, are actuated to provide locking of the device onto the housing.

As will be seen below, these elements can consist of retaining pins movable through a quarter-turn arranged on the handling device for holding suitable contact surfaces provided on the housing.

The following step consists of grasping of the roller cutter locking member by the handling device.

To this end, the handling device advantageously includes a suitable grasping element which allows grasping of the roller cutter by way of the roller cutter's locking member.

It also includes an actuating member designed to effect the unlocking of the roller cutter from the housing.

For example, in the device example that will be described below, this grasping element includes jaws capable of grasping the roller cutter's locking member and drivable in rotation between a locking position and an unlocking position of the roller cutter.

It will be noted that, while the handling device as described above uses the roller cutter's locking member for grasping the same, it could just as well be contemplated that the roller cutter have distinct means for fulfilling the two functions, to with a locking member and a grasping interface.

At this stage, the roller cutter is still preloaded in the housing and locked into the same.

The following step of the method consists of the release of said preload.

To this end, when this preload is provided by screws, the handling device loosens said screws.

It is then possible to unlock the roller cutter from the housing by actuating the unlocking element of the handling device toward the roller cutter unlocking position.

To make possible the handling of the roller cutter for its extraction, it is necessary that the set of elements permanently born the roller cutter be immobile with respect to one another so as to form a rigid block.

To this end, the locking member of the roller cutter is put back under load so that the elements of the roller cutter become immobile with respect to one another.

In the case illustrated in FIGS. 1B through 6, where the locking member of the roller cutter 1 is a bayonet 4 with a pivot connection to a crossmember 6 and where the preloading means of the roller cutter 1 are screws 5 carried by the bayonet, this comes down to tightening the screws 5 to put the bayonet 4 in abutment against the crossmember 6 of the roller cutter.

It is then possible to proceed with the extraction of the roller cutter from its housing, the components of the roller cutter being immobile with respect to one another and constituting a rigid block.

A relatively high force is necessary due to the buttressing resulting mainly from the operating loads which jam the roller cutter into its housing.

The roller cutter handling device therefore includes extraction elements (for example jacks) which make it possible to exert the necessary extraction force.

Once the roller cutter is extracted from the housing, the handling device is unclamped from the housing, then the housing is cleaned, with high-pressure water jets for example, so as to be able to more easily insert the new roller cutter.

Finally, the assembly consisting of the handling device and the roller cutter is conveyed to the workshop where the used roller cutter will be disassembled.

It is possible to proceed with cleaning the handling device before reusing it to install a new roller cutter.

Installation of a Replacement Roller Cutter

To install a new roller cutter in the housing, these steps are followed in reverse order.

To describe these mounting steps, FIGS. 1B through 1F will be relied on as an example, but it is understood that these figures show only one particular embodiment of the roller cutter and that the method is not limited to the installation of this particular roller cutter.

First of all, in the workshop, a new roller cutter (more precisely its locking member in the case illustrated here, or its grasping interface when the locking member does not fulfill the function of grasping the roller cutter) is attached on the handling device by means of the grasping element mentioned above.

So that the roller cutter can be handled, it is arranged that the different components are made immobile with respect to one another so that they constitute a rigid block.

Figure 1B:
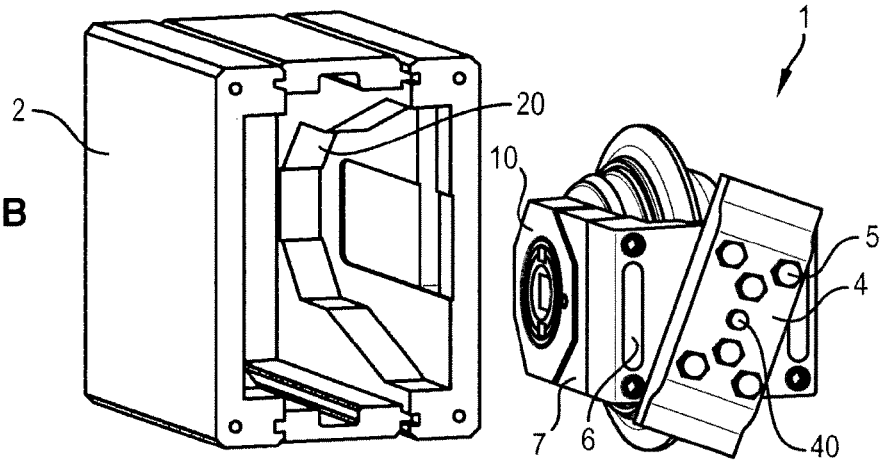
FIGS. 1B through 1F illustrate the different steps in the process of mounting a roller cutter conforming to the invention.
Figure 1C:
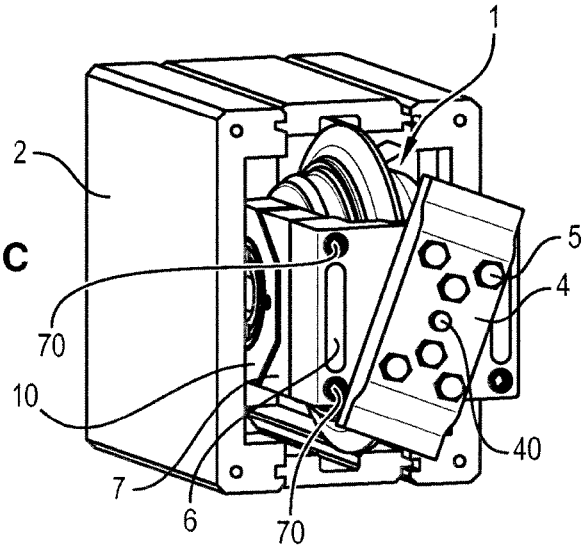

With reference to FIG. 1B, the roller cutter 1 is held by the handling device by the bayonet 4 (the handling device is not illustrated in FIGS. 1B through 1F to allow a better view of the different components of the roller cutter and of the housing).

The handling device supporting the roller cutter is brought into position facing the back face of the housing 2.

It is specified that the front face of the housing is defined as being the face from which the rotating part of the roller cutter extends toward the cutting face; the back face of the housing is the opposite face, through which the roller cutter is inserted.

The housing 2 has contact surfaces (not illustrated here) which allow pre-centering and guidance, then clamping of the handling device.

These contact surfaces are for example male shapes provided on its outer walls, constituting guide rails which cooperate with complementary female shapes provided on the handling device.

Once it is in position centered on the housing, the handling device is clamped to the same by its clamping elements.

With reference to 1C, the grasping element of the handling device is then moved forward to insert the roller cutter 1 into its recess within the housing 2 all the way to the stop.

Thanks to the contact areas 20 provided in the inner walls of the housing 2, the roller cutter 1 is automatically centered with respect to the same.

Further, the shape of the contact surfaces 20 is designed to provide support surfaces for the ends 10 of the roller cutter shaft in the front part of the housing.

Figure 1D:
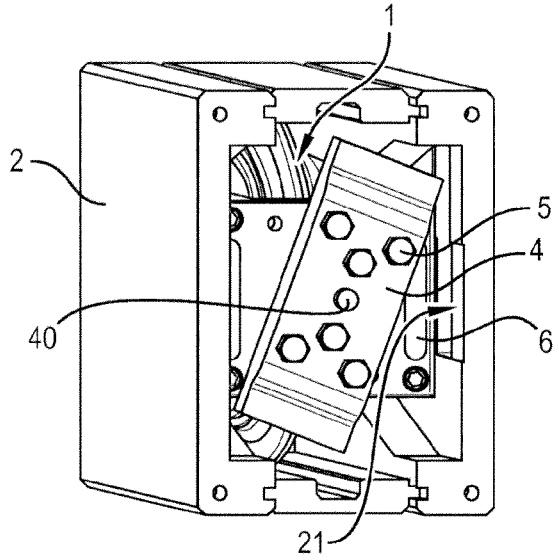

With reference to FIG. 1D, the screws 5 which hold the bayonet 4 under load against the crossmember 6 are then unscrewed, so as to allow rotation of the bayonet.

Figure 1E:
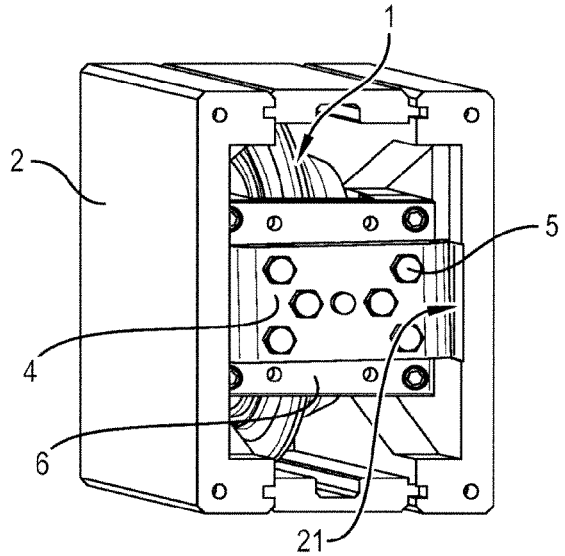

With reference to FIG. 1E, the grasping element which holds the bayonet 4 is driven in rotation toward the locking position of the roller cutter 1 in the housing 2.

In the case illustrated here, the bayonet 4 is pivoted 90° and lodges behind the contact surfaces 21 (also visible in FIG. 6) provided in the housing 2, which has the effect of locking the roller cutter into the housing.

It is then a matter of preloading the roller cutter so that it can resist the forces to which it is subjected during cutting.

To this end, the actuating member of the handling device actuates the preloading means of the roller cutter to apply a preload through the back of the housing, this force being resisted by the supporting surfaces 20 of the housing 2.

The application of the preload can be carried out by simply tightening the screws 5 in the crossmember 6, or preferably by the use of jacks between the crossmember 6 and the bayonet 4 followed by the abutment of the screws 5 in the crossmember 6.

This is an "irreversible" preloading in the sense that the means of applying the preload do not allow it to be released in the absence of action by an operator.

Figure 1F:
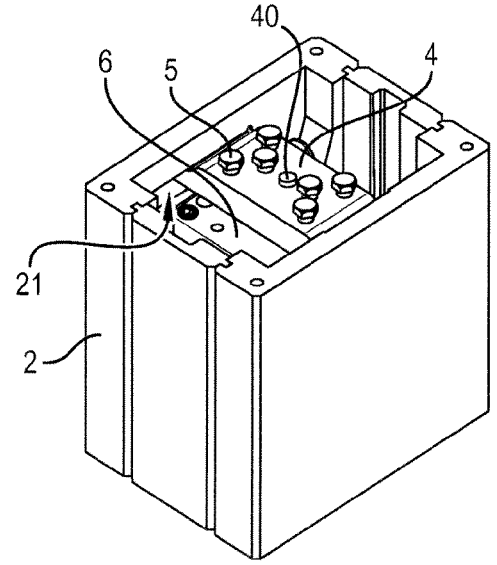

In the case illustrated in FIG. 1F, the screwdriver heads of the handling device tighten the screws 5 to the desired torque.

The installation of the roller cutter with preloading being completed, the handling device is detached from the roller cutter and it is unclamped from the housing.

The implementation of the method which has just been described has therefore been made possible by the design of a new structure for the roller cutter and of a new roller cutter handling device, which will be described consecutively below.

Compared to the known method wherein the roller cutter is installed on the cutting head, then attached and preloaded by means of screws and wedges, the method using the roller cutter-handling device assembly has the advantage of being capable of implementation by a mechanized device, which allows a long and tedious human intervention to be reduced or eliminated.

Further, centering of the roller cutter in the housing is accomplished automatically by the walls of the housing, which avoids the use of wedges as in existing roller cutters.

It can also be noted that, the housing being devoid of threads, it poses little risk of damage and requires little repair.

Finally, the housing can be installed on an existing cutting head without requiring any special adaptation of the same.

It is clearly understood, however, that manual installation of the cutting head as practiced in the prior art is still possible; this installation is even facilitated by the fact that the roller cutter permanently bears all the elements necessary for mounting it, which dispenses the operators from handling the screws and wedges customarily used.

Example of a Roller Cutter Suited to the Implementation of the Method

A roller cutter design suited to the implementation of this method will now be described with reference to FIGS. 2 through 6.

This is a roller cutter illustrated in FIGS. 1B through 1F which were commented on above.

Figure 2:
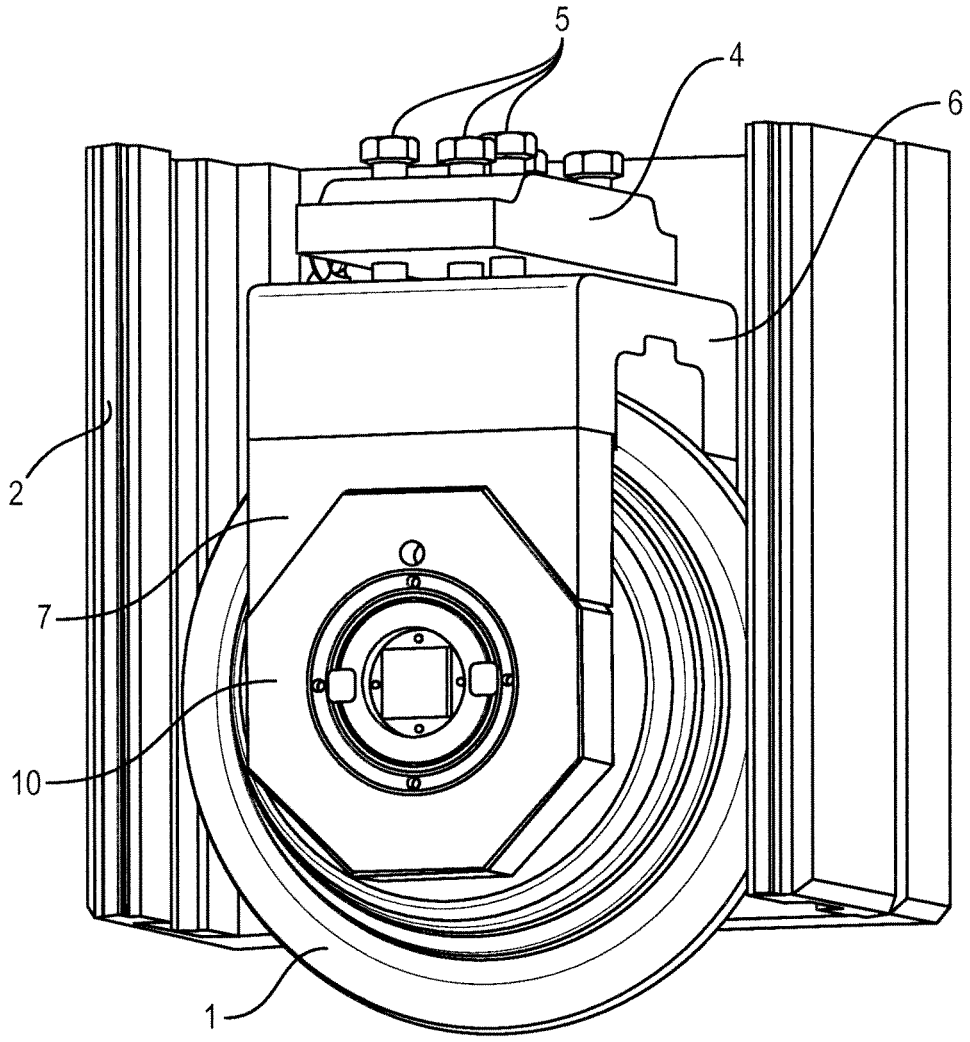
FIG. 2 shows the roller cutter in position in its housing according to the invention.
Figure 3:
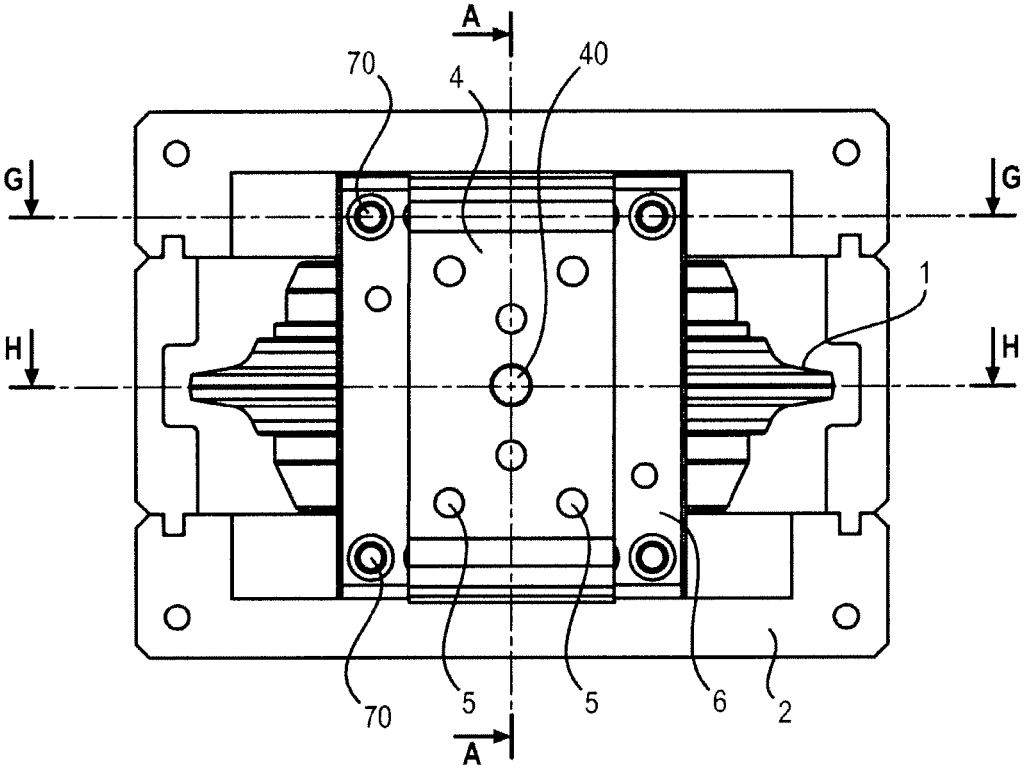
FIG. 3 is a top view of a roller cutter in position in its housing.
Figure 4:
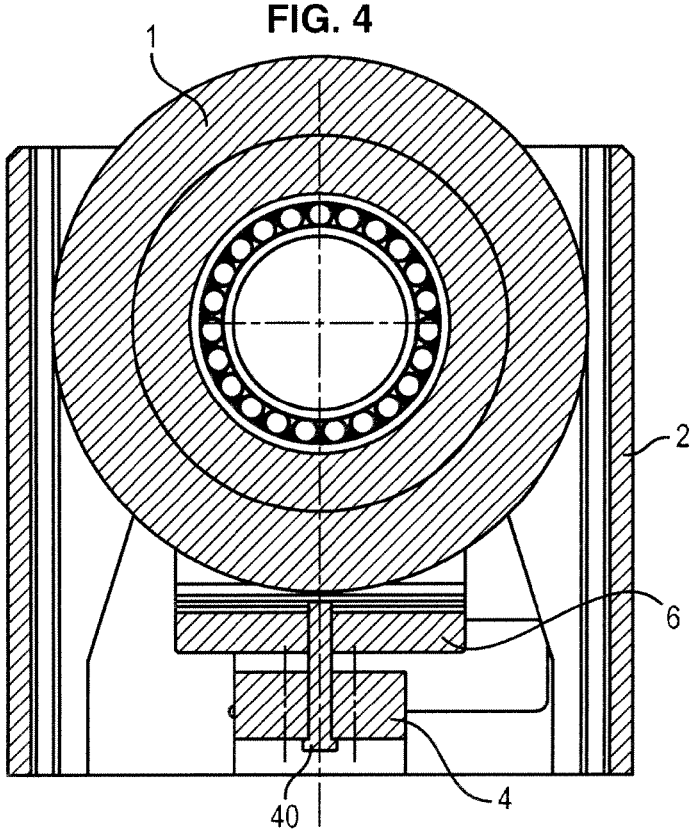
FIG. 4 is a section view along H-H of the roller utter and of the housing illustrated in FIG. 3.
Figure 5:
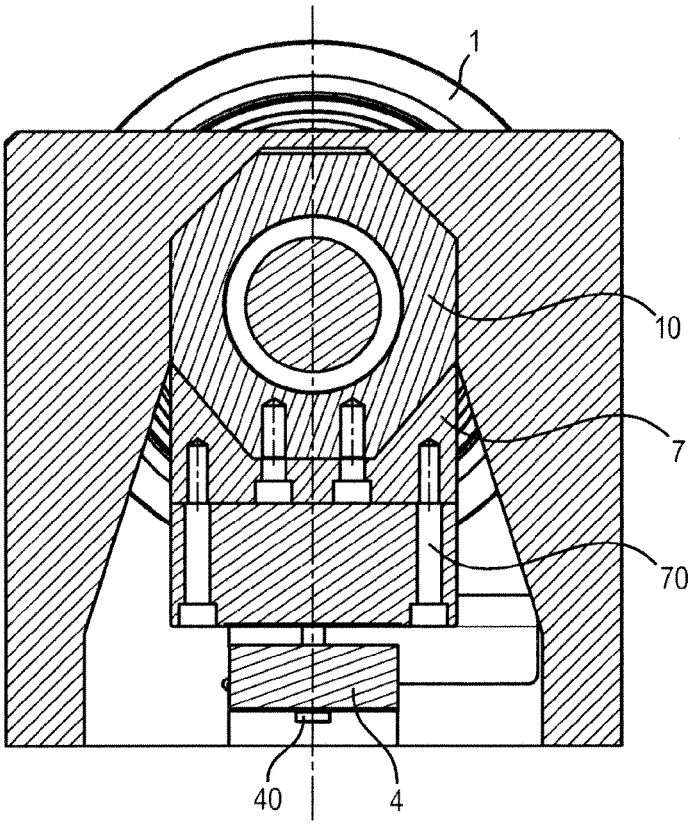
FIG. 5 is a section view along G-G of the roller cutter and of the housing illustrated in FIG. 3.
Figure 6:
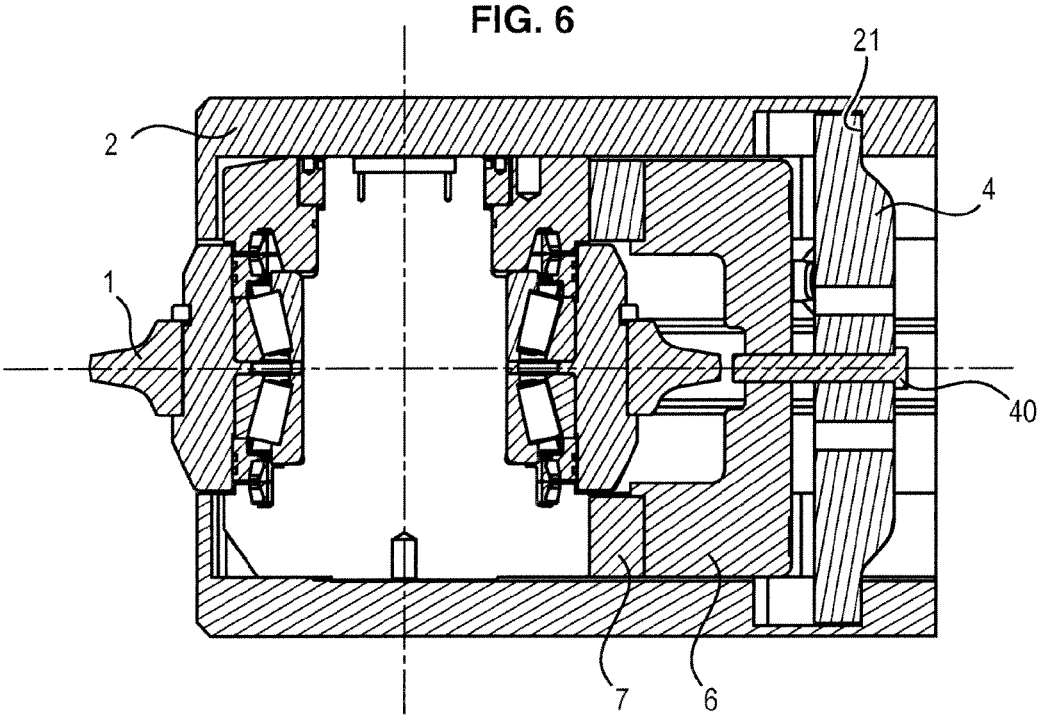
FIG. 6 is a section view along A-A of the roller cutter and of the housing illustrated in FIG. 3, FIGS. 7A and 7B show the roller cutter handling device, the housing and the roller cutter in position respectively inserted in and removed from the housing during the replacement cycle.

FIG. 2 illustrates the roller cutter 1 inside the housing 2, one of the side walls of the housing not being shown.

In a manner known per se, the roller cutter 1 is freely movable in rotation about a shaft having two ends 10 arranged on either side of the roller cutter.

The ends 10 of the shaft have for example a polygonal shape which allows them to be socketed into two supports 7 having a complementary shape (octagonal in the example of FIG. 2), to which they are attached by screws.

Said supports 7 are connected by a crossmember 6 which has a U shape overall.

The supports 7 are attached to the crossmember 6 by screws 70 (also visible in FIGS. 3 and 5) placed at the four corners of the same.

Further, the roller cutter 1 permanently bears a locking member that can be actuated between a locking position wherein the roller cutter is held inside the housing 2 and an unlocking position allowing the extraction of the roller cutter from the housing.

Here, this locking member includes a bayonet 4 which is mounted on the crossmember 6 by a pivot connection about a pivot pin 40.

The roller cutter also permanently bears means of preloading it inside the housing.

These preloading means are preferably irreversible mechanical members such as bolts and/or jacks arranged between the locking member and the roller cutter crossmember.

In the present text, the term "irreversible" means that these members can not release the applied preload without a deliberate intervention using a dismantling device.

In the example illustrated here, these preloading means are screws 5 carried in a way that precludes loss on the bayonet 4 and which, when they are tightened to an appropriate torque, apply to the roller cutter locked into the housing a preload of the intensity desired.

It is important to recognize that the set of components necessary for locking the roller cutter into the housing and for preloading the roller cutter (to with mainly, in the example illustrated here, the bayonet 4 and the screws 5) are permanently born by the roller cutter, that is they are mechanically connected to the same with no possibility of removal without deliberate dismantling (for the purpose of repair, for example).

Further, these components can be immobilized with respect to one another for the purpose of constituting a rigid block allowing handling of the roller cutter.

It is self-evident that a person skilled in the art can contemplate a different roller cutter structure, also usable in the method described above, without thereby departing from the scope of the present invention.

For example, he could use a locking principle other than the bayonet 4, so long as the attachment elements were permanently born by the roller cutter and could constitute a rigid assembly for the handling of the roller cutter.

Likewise, the number of screws shown in these figure is only by way of indication, and a person skilled in the art can of course modify the number of screws and/or suggest other means of applying the preload without departing from the scope of the present invention.

Roller Cutter Handling Device

Figure 9:
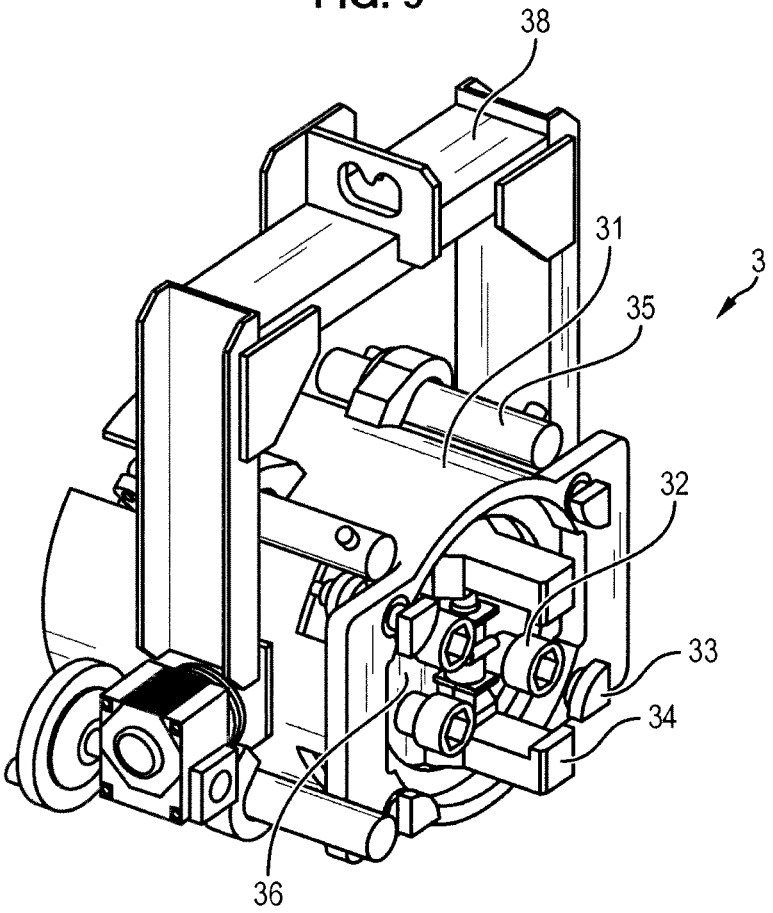
FIG. 9 shows a perspective view of the handling device for the roller cutter (which is not shown), FIGS. 10A and 10B respectively show and example of a handling device mounted on a semi-automatic positioning means and an example of a handling device mounted on the terminal part of a robotic handling effector.

FIG. 9 illustrates an example of a handling device 3 for the roller cutter.

The device 3 includes a case 31 which supports the elements that allow it to be centered on the housing.

The centering elements are for example forms arranged on the frame which cooperate with complementary forms of the housing, thus fulfilling the function of guiding the device with respect to the housing.

In the example illustrated here, the clamping elements include four pins 33 having the shape of a quarter-circle and movable in rotation.

These pins 33 lodge themselves within grooves arranged on the housing so as to provide attachment of the frame 3 on the housing 2.

The device 3 also includes an actuating device 36 housed in the case 31.

Here, the actuating member is movable in translation (by means of jacks 35) and in rotation with respect to the case 31.

The device 3 also includes a grasping element for holding the roller cutter, and more particularly the locking member of the same.

The grasping element is mounted on the actuating member 36, and can thus be driven both in translation to insert or extract the roller cutter from the housing and in rotation to lock or unlock the roller cutter inside the housing.

In the example illustrated here, the grasping element includes jaws 34 designed to seize the bayonet 4 of the roller cutter.

The jaws 34 can open to a distance greater than the width of the bayonet to allow it to be grasped or released, and can be brought together to permanently hold the bayonet.

Thanks to their connection with the actuating member, the jaws 34 are also movable in rotation by at least a quarter-turn between a position where the bayonet is in a position allowing the insertion of the roller cutter into the housing and a position where the bayonet is in a position locking the roller cutter into the housing.

The handling device 3 also includes means for applying or releasing the preload on the roller cutter, which cooperate with the preloading means of the roller cutter.

These means include screwdriving heads 32 connected to screwdriver bodies 37 mounted in the actuating member 36 and designed to tighten or loosen the roller cutter preloading screws 5.

The device 3 further includes roller cutter extraction elements.

In the example illustrated here, these extraction means are jacks 35 arranged between the case 31 and the actuating member 36.

Figure 7A:
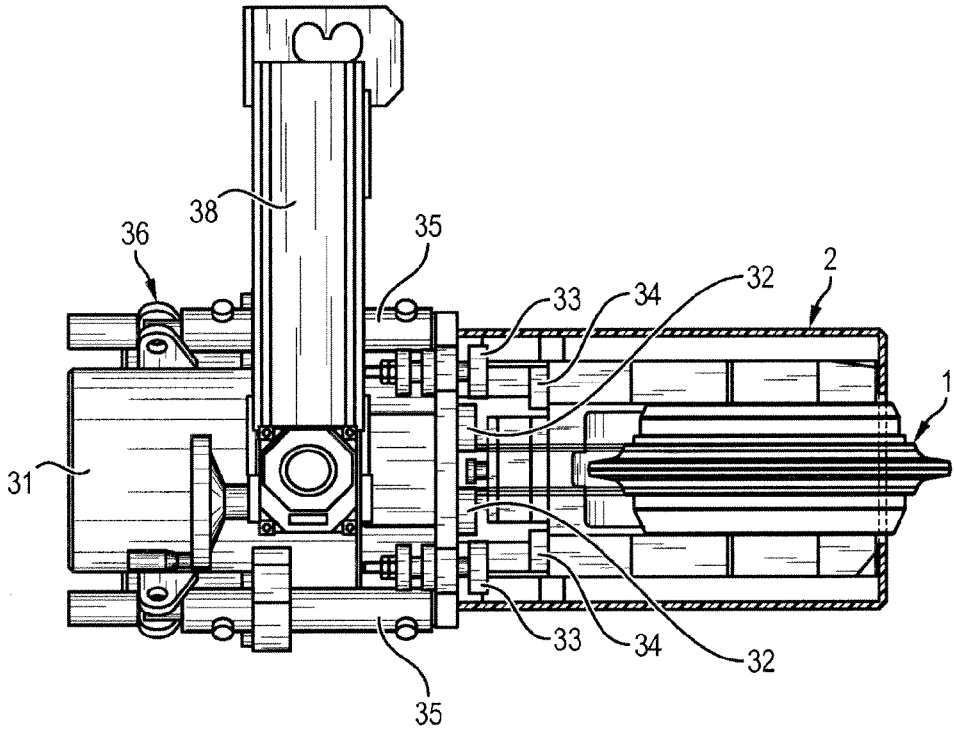

In the situation illustrated in FIG. 7A, where the roller cutter is in the operating position in the housing 2, the case 31 of the device 3 is clamped on the housing 2 by means of the pins 33 and the jacks 35 are in the retracted position, such that the actuating member 36, and hence the jaws 34 and the screwdriving heads 32 can respectively drive the bayonet and the roller cutter preloading screws.

Figure 7B:
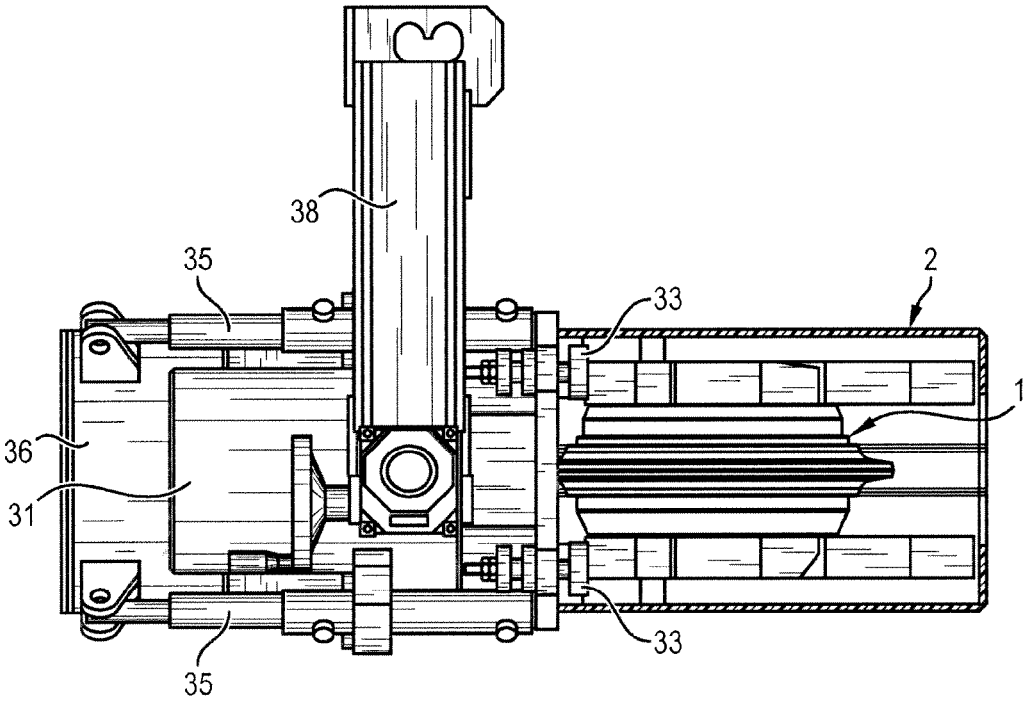
Figure 8:
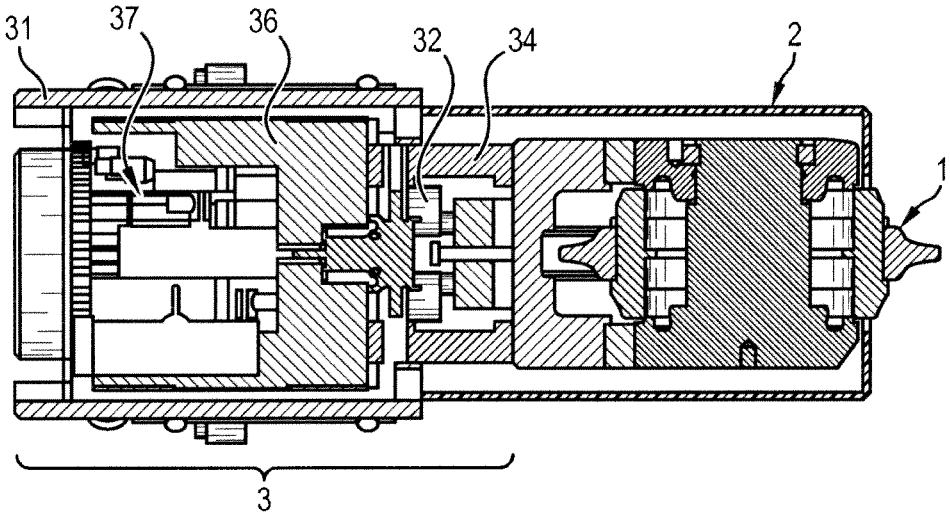
FIG. 8 shows a section view in the longitudinal plane of the objects illustrated in FIG. 1A.

In the situation illustrated in FIG. 7B, where the roller cutter 1 is being extracted from the housing 2, the frame is still clamped to the housing 2 thanks to the pins 33, but the jacks 35 are in the deployed position, which has the effect of withdrawing the actuating member 36, and hence the jaws 34 that hold the bayonet.

The device 3 can also include any other component that a person skilled in the art deems useful.

Thus for example it includes means (not illustrated) for cleaning the housing after the extraction of the used roller cutter.

These means can consist in particular of high pressure water jets.

Figure 10A:
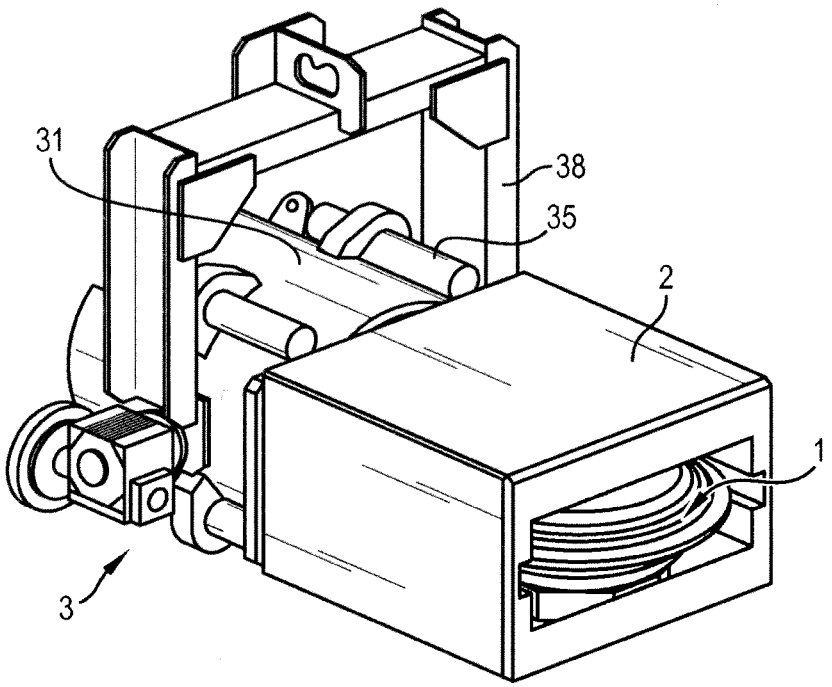

In the example illustrated in FIG. 9 (as well as in FIG. 10A, where it is shown in perspective with the roller cutter), the case 31 of the handling device is surrounded by an arch 38 which is designed to be hooked to a pulley block (not shown).

This corresponds to a semi-automated embodiment, which can be implemented for example in degraded mode, during maintenance operations.

Figure 10B:
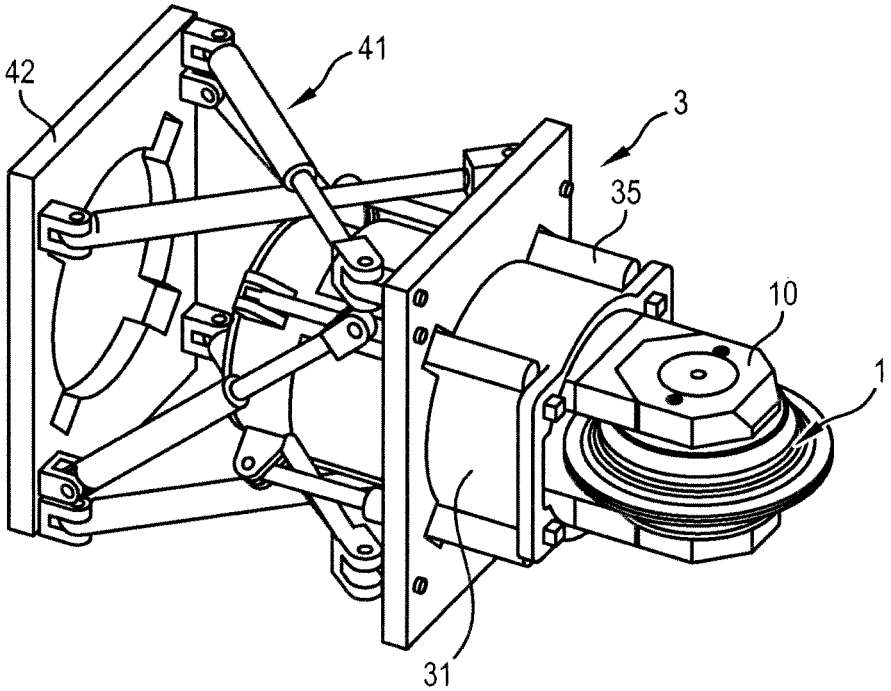

As for FIG. 10B, it illustrates an embodiment of the handling device 3 designed to be mounted on the terminal part of a robotic handling effector, which is preferentially used for the operation of the tunnel boring machine.

Only a forward plate 42 of the handling robot is shown in this figure, which has a recess for receiving the handling device.

Said robot is particularly moved in translation along the axis of the housing, and has means for controlling the handling device.

The handling device 3 is connected with the plate 42 by a hexapod type jack assembly 41 which makes it possible to move the device 3 for the purpose of locking it on the housing, then withdrawing it.

The handling device which is illustrated in particularly suited to the roller cutter shown.

It is naturally understood that the shape of this handling device can vary according to the shape of the corresponding roller cutter without thereby departing from the scope of the present invention.

Finally, it is self-evident that the examples just given are only particular illustrations and are in no way limiting as regards the details of implementation of the invention.

The invention claimed is:

1. A method for replacing a used roller cutter mounted within a housing built into the cutting head of a tunnel boring machine by a replacement roller cutter, said method being implemented with used and replacement roller cutters each having, permanently attached thereto, a member for locking the used or replacement roller cutter within the housing and a member for applying preload members to said used or replacement roller cutter, said method including the steps:

a) removing the used roller cutter from said housing, comprising the following steps:

clamping, onto the housing, a handling device designed for grasping and guiding the used roller cutter, grasping of the used roller cutter by the handling device, releasing the preload members applied to the used roller cutter, wherein the member for applying said preload members remains attached to the used roller cutter, unlocking of the used roller cutter from the housing, extracting the used roller cutter from the housing, wherein the member for locking remains attached to the used roller cutter, unclamping the handling device from the housing, b) installing in said housing of a replacement roller cutter, comprising the following steps:

grasping of the replacement roller cutter by the handling device, docking, then clamping the handling device on the housing, inserting the replacement roller cutter into the housing, said replacement roller cutter being guided by the handling device, locking the replacement roller cutter into the housing, applying the preload members to the replacement roller cutter.

2. The method of claim 1, wherein the used or replacement roller cutter is held by the handling device by its locking member.

3. The method of claim 1, being implemented by a mechanized roller cutter handling device.

4. A replacement roller cutter assembly configured to be removably mounted in a housing built into a cutting head of a tunnel boring machine, comprising a replacement roller cutter;

a locking member suitable for locking the replacement roller cutter assembly within the housing; and a member for applying preload members to the replacement roller cutter assembly, wherein the locking member and the preload members are permanently attached to the replacement roller cutter such that the replacement roller cutter, the locking member and the preload members are removable as a whole from the housing.

5. The replacement roller cutter assembly of claim 4, wherein said locking member is designed to be immobilized relative to the replacement roller cutter, so that the replacement roller cutter assembly constitutes a rigid block.

6. The replacement roller cutter assembly of claim 4, wherein the locking member includes a bayonet movable in rotation between a position for inserting the replacement roller cutter assembly into the housing and a position for locking the replacement roller cutter assembly into the housing.

7. The replacement roller cutter assembly of claim 6, wherein the preload members include screws and said screws for preloading the replacement roller cutter assembly are carried by the bayonet in a manner that precludes loss.

8. The replacement roller cutter assembly of claim 4, wherein the preload members include screws.

9. A device for handling a replacement roller cutter, comprising:

an element for clamping onto a housing intended to receive the replacement roller cutter, an element for grasping a used roller cutter, means for releasing or applying preload members to the used roller cutter, wherein said preload members are permanently attached to the used roller cutter, an element for extracting the used roller cutter from the housing, a member for actuating a locking member of the replacement roller cutter to lock the replacement roller cutter into the housing.

10. The device of claim 9, further including means for cleaning the housing.

11. The device of claim 9, further including means for transporting, docking and/or clamping onto the housing by a robot.

* * * * *